US006931893B2

(12) United States Patent
Agbay

(10) Patent No.: US 6,931,893 B2
(45) Date of Patent: Aug. 23, 2005

(54) LOCKING DEVICE FOR A METER SOCKET

(75) Inventor: Anthony J. Agbay, Auburn, MA (US)

(73) Assignee: Inner-Tite Corp., Holden, MA (US)

( * ) Notice: Subject to any disclaimer, the term of this patent is extended or adjusted under 35 U.S.C. 154(b) by 0 days.

(21) Appl. No.: 10/649,166

(22) Filed: Aug. 27, 2003

(65) Prior Publication Data

US 2005/0044907 A1 Mar. 3, 2005

(51) Int. Cl.[7] ..... E05B 65/48

(52) U.S. Cl. ..... 70/2; 70/34; 70/56; 70/63; 70/159; 70/164; 70/451; 70/466; 292/281; 292/340

(58) Field of Search ..... 70/2, 6–14, 34, 70/63, 54–56, 158–173, 370, 371, 386, 451, 466; 248/551–553; 292/281, 282, 286, 340, DIG. 53

(56) References Cited

U.S. PATENT DOCUMENTS

| | | | |
|---|---|---|---|
| 1,241,459 | A | 9/1917 | Woodard |
| 1,262,795 | A | 4/1918 | Holen |
| 2,121,386 | A | 6/1938 | Henrickson |
| 3,275,363 | A | 9/1966 | Bates et al. |

(Continued)

OTHER PUBLICATIONS

Inner–Tite Corp. product data, "Jiffy Lock", Aug. 2002.
Inner–Tite Corp. product data, "Fort Knox Locking Device", Jun. 2002.
Inner–Tite Corp. product data, "Deadbolt Locking Device".
Inner–Tite Corp. product data, "Hammerlock Locking Device", Dec. 2002.
Inner–Tite Corp. Electric Utility Meter Locking & Security Devices Price List, Mar. 2002.

*Primary Examiner*—Lloyd A. Gall
(74) *Attorney, Agent, or Firm*—Bowditch & Dewey, LLP

(57) ABSTRACT

A lock assembly has a clip, a base, a body, and an interlocking mechanism. The lock assembly is for an enclosure, such as an electrical meter socket with a box, having a side wall and a cover. The clip has a "U" shaped portion for encircling the side wall of the enclosure. The "U" shaped portion has an inner leg, a spanning portion, and an outer leg. The clip has a support portion projecting from an inner leg for supporting the cover of the enclosure. An interface portion of the clip projects from the outer leg. The base is interposed between the side wall of the box and the outer leg of the clip. The base has a flange portion projecting outward and underlying the interface portion of the clip. The flange portion has a hole. The body has an "L" shape including a cover retaining portion and an extending portion. The extending portion has a bore extending from the cover retaining portion. The body has a cavity opening onto an inner surface. The cavity receives the flange portion of the base and the interface portion of the clip. The interlocking mechanism is receivable by the bore of the body and interrelates with the flange portion of the clip and the flange portion of the base for securing the body to the base and the clip, and securing the cover to the box.

14 Claims, 10 Drawing Sheets

U.S. PATENT DOCUMENTS

| | | | | | |
|---|---|---|---|---|---|
| 3,938,839 | A | | 2/1976 | Collier | 292/258 |
| 3,980,332 | A | | 9/1976 | King, Sr. | 292/320 |
| 4,031,722 | A | * | 6/1977 | Michelman et al. | 70/63 |
| 4,062,572 | A | | 12/1977 | Davis | 285/55 |
| 4,080,811 | A | | 3/1978 | Nielsen, Jr. | 70/164 |
| 4,096,718 | A | * | 6/1978 | Michelman et al. | 70/63 |
| 4,107,959 | A | | 8/1978 | Skarzynski et al. | 70/159 |
| 4,120,182 | A | | 10/1978 | Michelman et al. | 70/63 |
| 4,144,729 | A | | 3/1979 | Nielsen, Jr. | 70/63 |
| 4,152,910 | A | | 5/1979 | Swisher | 70/159 |
| 4,202,574 | A | | 5/1980 | Redmayne | 292/228 |
| 4,254,647 | A | | 3/1981 | Finck, Jr. | 70/77 |
| 4,414,829 | A | | 11/1983 | Nielsen, Jr. et al. | 70/160 |
| 4,733,893 | A | | 3/1988 | Davis et al. | 292/320 |
| 5,007,258 | A | | 4/1991 | Mahaney | 70/159 |
| 5,127,244 | A | * | 7/1992 | Myers | 70/2 |
| D344,441 | S | | 2/1994 | Mahaney | D8/333 |
| 5,315,849 | A | | 5/1994 | Georgopoulos | 70/34 |
| 5,402,958 | A | | 4/1995 | Mahaney | 242/388.1 |
| 5,871,030 | A | | 2/1999 | Agbay | 137/364 |
| 6,406,074 | B1 | | 6/2002 | Mahaney | 292/327 |
| D463,248 | S | | 9/2002 | Rafferty | D8/344 |
| 6,742,365 | B1 | * | 6/2004 | Sullivan et al. | 70/2 |
| 6,763,691 | B1 | * | 7/2004 | Rafferty | 70/164 |

* cited by examiner

LOCKING DEVICE FOR A METER SOCKET

BACKGROUND OF THE INVENTION

Electrical and other types of utilities have boxes mounted both to the inside and to the outside of buildings through which the utility, such as electricity, passes. While the boxes typically have a security tag to show any tampering, the security tag is easy to break to gain access to the box. There is a growing problem of tampering with these boxes, including electric meters, to obtain services without being properly charged. While devices exist to decrease the likelihood of persons tampering with the box, the utility company has to balance the cost of installation with the cost of the stolen utility.

SUMMARY OF THE INVENTION

It is recognized that utility boxes come in different shapes and styles. The cost of installing security devices securely in certain situations does not render the security device cost effective.

The present invention relates to a lock assembly for an enclosure, such as an electrical meter socket having a side wall with a flange and a cover. The lock assembly has a clip, a base, a body, and an interlocking mechanism.

The clip has a "U" shaped portion for encircling the side wall of the enclosure, such as a box of a meter socket. The "U" shaped portion has an inner leg, a spanning portion, and an outer leg. The clip has a support portion projecting from an inner leg for supporting the cover of the enclosure. An interface portion of the clip projects from the outer leg.

The base is interposed between the side wall of the enclosure and the outer leg of the clip. The base has a flange portion projecting outward and underlying the interface portion of the clip. The flange portion has a hole.

The body has an "L" shape including a cover retaining portion and an extending portion. The extending portion has a bore that extends from the cover retaining portion. The body has a cavity opening onto an inner surface. The cavity receives the flange portion of the base and the interface portion of the clip.

The interlocking mechanism is received by the bore of the body and interrelating with the flange portion of the clip, and the flange portion of the base for securing the body to the base and the clip, and securing the cover to the enclosure.

In a preferred embodiment, the support portion of the clip has a shelf supported by a pair of support brackets extending from the inner leg portion. The shelf portion is in close proximity to the cover of the meter socket when the enclosure, the meter socket, is secured.

In an embodiment, the clip is formed of a single piece of material. The interface portion of the clip is a flange portion having a hole.

In a preferred embodiment, the base has a tapered upper edge for facilitating installation. The base has a thinned upper portion for receipt of the outer leg of the clip. The hole in the base has an enlarged area for receipt of a locking device of the interlocking mechanism.

In a preferred embodiment, the body has a plurality of surfaces angled to each other and curved surfaces to limit the surfaces from being securely retained by a tool. The body has at least one hole extending in the cover retaining portion and at least one hardened steel pin received by the hole in the base of the body. The body has a "U" shaped lip for encircling the base.

In a preferred embodiment, the interlocking mechanism is a barrel lock with a pair of detents.

In one embodiment, an "L" shape body portion includes a cover retaining portion and an extending portion. The extending portion has a bore. The extending portion has a cavity opening onto an inner surface. A "U" shaped lip defines a groove. The groove has the cavity. The body has at least one hole extending in the cover retaining portion and further comprising at least one hardened steel pin received by the hole in the base of the body. The body has a plurality of surfaces angled to each other and curved surfaces to limit the surfaces from being securely retained by a tool.

The invention relates to a method of locking a meter socket having a box with a side wall with a flange on an upper edge. The steps include placing a clip over the flange. A base is placed between the side wall of the box and an outer leg of the clip. The cover of the electrical meter socket is placed on the box. A body of a lock is installed with a flange portion of the base received by a cavity of the body and a cover retaining portion of the body overlying the cover. A locking device is inserted in a bore of the base and through an opening in the flange portion of the base.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1A:
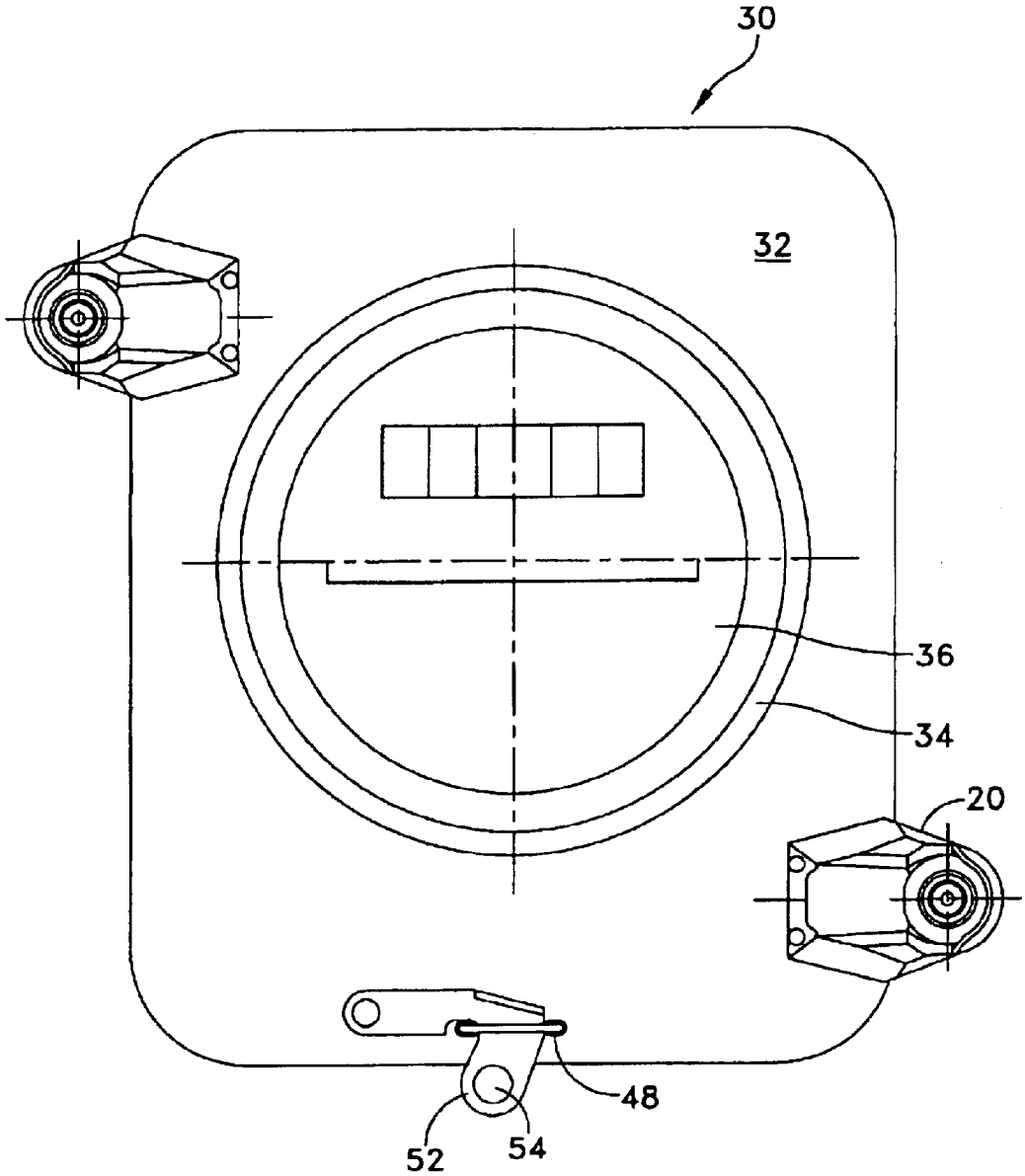
FIG. 1A is a front view of an electrical meter socket with an electronic meter and a pair of locking devices according to the invention.

Referring to the drawings in detail, there is illustrated a locking device in accordance with the present invention designated generally as 20.

Figure 1B:
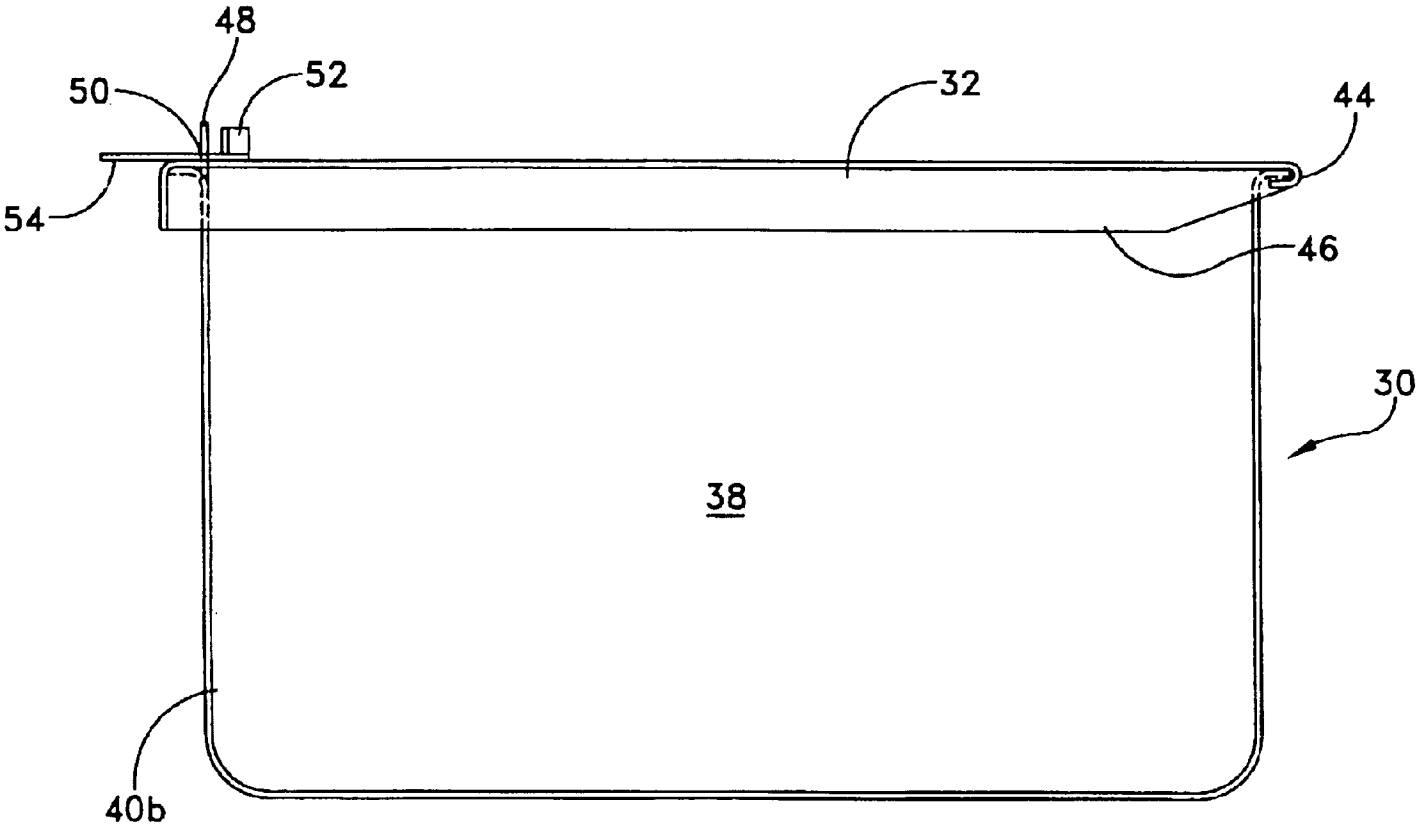
FIG. 1B is a side view of the electrical meter socket.
Figure 2:
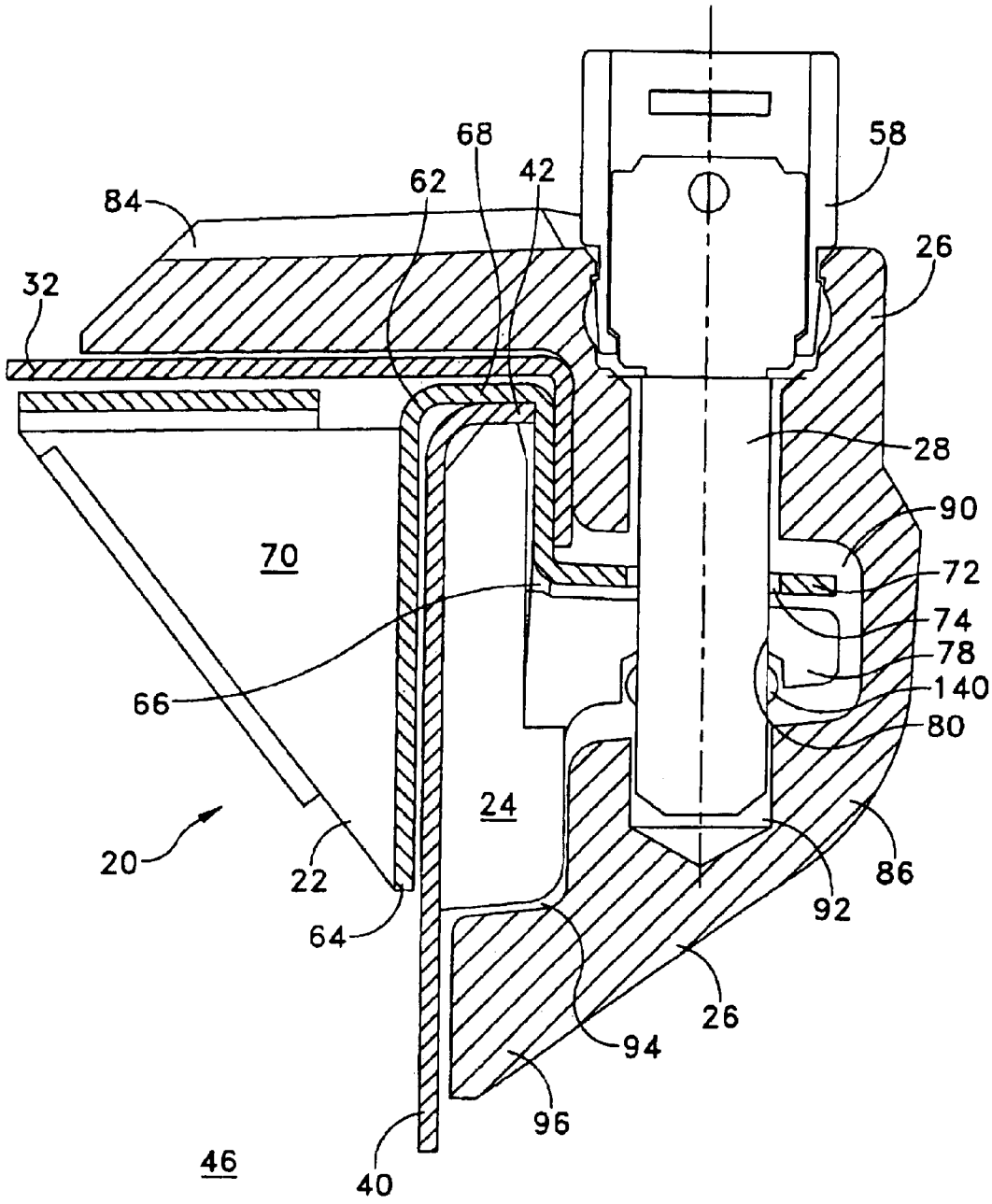
FIG. 2 is a sectional view of a portion of the meter box with a cover and the locking device.

Referring to FIG. 1A, the locking device 20 according to the invention is shown on an electrical meter socket 30. The electrical meter socket 30 has a box and a cover 32. The electrical meter socket 30 has an adaptor or receptacle, not shown, that accepts prongs from an electrical meter unit 36. The meter unit 36 has a glass dome 34 through which the dials can be read. The cover 32 has an opening through which the glass dome 34 projects. In order to gain access to the meter unit 36, the cover 32 must be removed from a box 38, as best seen in FIG. 1B, of the electrical meter socket 30. The box 38 has four side walls 40 with each side wall 40 having a lip or flange 42 at the upper edge as best seen in FIG. 2. In conventional use, the cover 32 has a crimped edge 44 which receives one of the lips or flanges 42 of the box 38 as seen in FIG. 1B, and acts as a hinge. The remaining edges of the cover 32 each have a downward projecting flange 46.

One of the side walls 40 of the box 38, the bottom side wall 40*b* of the socket in FIG. 1B, has a projection 48 with a slot 50 that receives a pivotable seal latch 52. The pivotable seal latch 52 is mounted to the cover 32 and has an opening 54 to receive a security tag.

As indicated in the background of the invention, the electrical meter socket 30 as configured, allows the security tag or the seal latch to be damaged to gain access to the box 38. Furthermore, the crimped edge 44 of the cover 32 can be bent to allow access into the meter box.

The locking device 20 as shown in FIG. 1A retains the cover 32 of the electrical meter socket 30 in engagement with the box 38, therein preventing access to the electrical meter unit 38.

Referring to FIG. 2, a sectional view of the electrical meter socket 30 with a portion of the cover 32 and the box 38 is shown. The wall 40 of the box 38 has the flange 42 at the upper edge. The cover 32 has the flange 46 which projects downward around the flange 42 of the side wall 40. The locking device 20 according to the invention has four main components: a clip 22, a base 24, a body 26, and a barrel lock 28. The embodiment shown also shows a ferrule 58.

The clip 22 has a "U" shaped portion 62 with an inner leg portion 64, an outer leg portion 66, and an interposed spanning portion 68 that overlies the flange 42 of the wall 40. In addition, the clip 22 has support bracket portions 70 to support the cover 32. The support bracket portion 70 incorporates the inner leg portion 64. A retaining flange portion 72 projects from the outer leg portion 66 of the "U" shaped portion 62. The retaining flange portion 72 has a hole 74 that aligns with holes or bores in the other components of the locking device 20 as explained below.

The base 24 is positioned in between the wall 40 of the box 38 of the electrical meter socket 30 and the outer leg portion 66 of the "U" shaped bracket or portion 62 of the clip 22. The base 24 is held in an interference fit between the side wall 40 of the box 38 and the clip 22 in position. The base 24 likewise has a retaining flange portion 78 which extends outward and underlies the retaining flange portion 72 of the clip 22. The retaining flange portion 78 of the base 24 has an opening 80 through which the barrel lock 28 extends.

Still referring to FIG. 2, the body 26 of the locking device 20 generally encircles the base 24 and portions of the clip 22 to prevent access to these components when the locking device 20 is in the lock installed position. The body 26 has a generally inverted "L" shape with a cover retaining portion or top portion 84 of the "L" overlying the cover 32. Therefore, a portion of the cover 32 is interposed between the cover retaining portion or upper potion 84 of the "L" shape of the body 26 and the support bracket portion 70 of the clip 22. The body 26, in addition, has an extending portion 86 that projects downward. The extending portion 86 has a cavity 90 for receiving the retaining flange portion 72 of the clip 22 and the retaining flange portion 78 of the base 24. The vertical extending portion 86 of the body 26 has a bore 92 that accepts the barrel lock 28. A ferrule 58 may be located at the top of the bore 92 that receives the barrel lock 28. In addition to the cavity 90, the extending portion 86 has a groove or pocket 94 formed with a raised "U" shaped lip 96 around the pocket 94. The pocket 94 receives a portion of the base 24 with the "U" shaped lip 96 encircling the portion of the base 24.

Figure 3A:
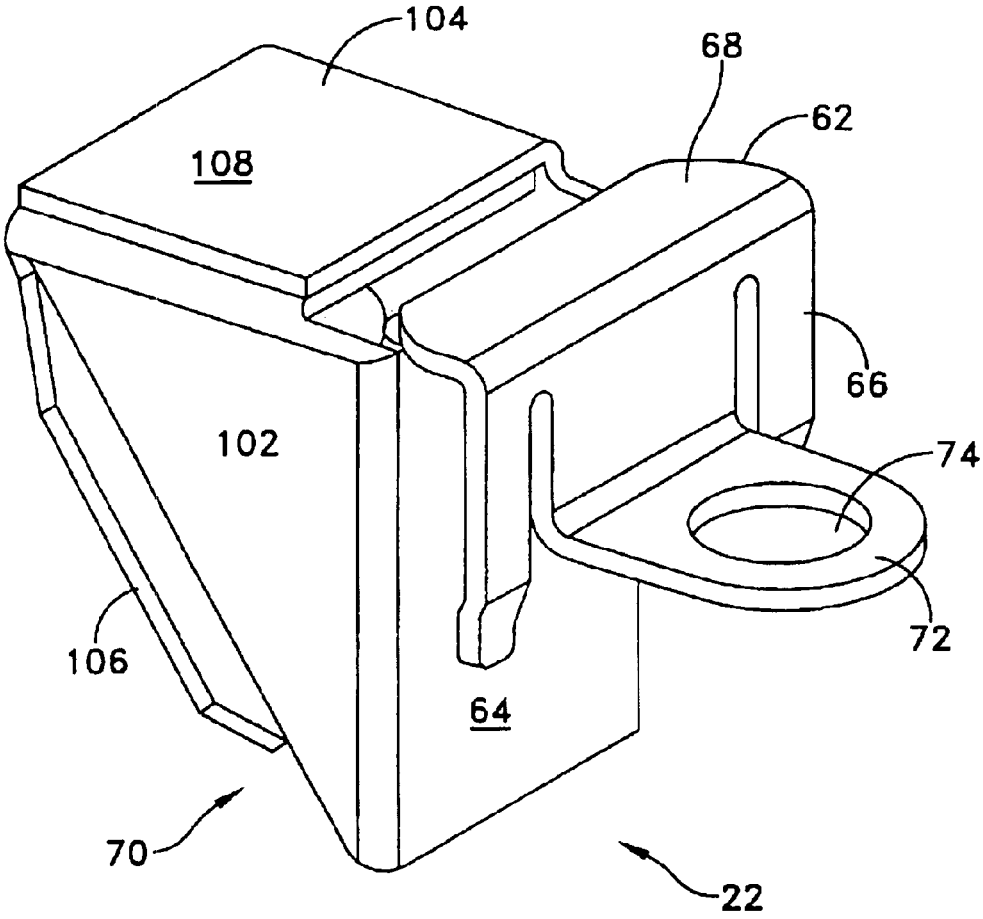
FIG. 3A is a perspective view of the clip of the locking device.
Figure 3B:
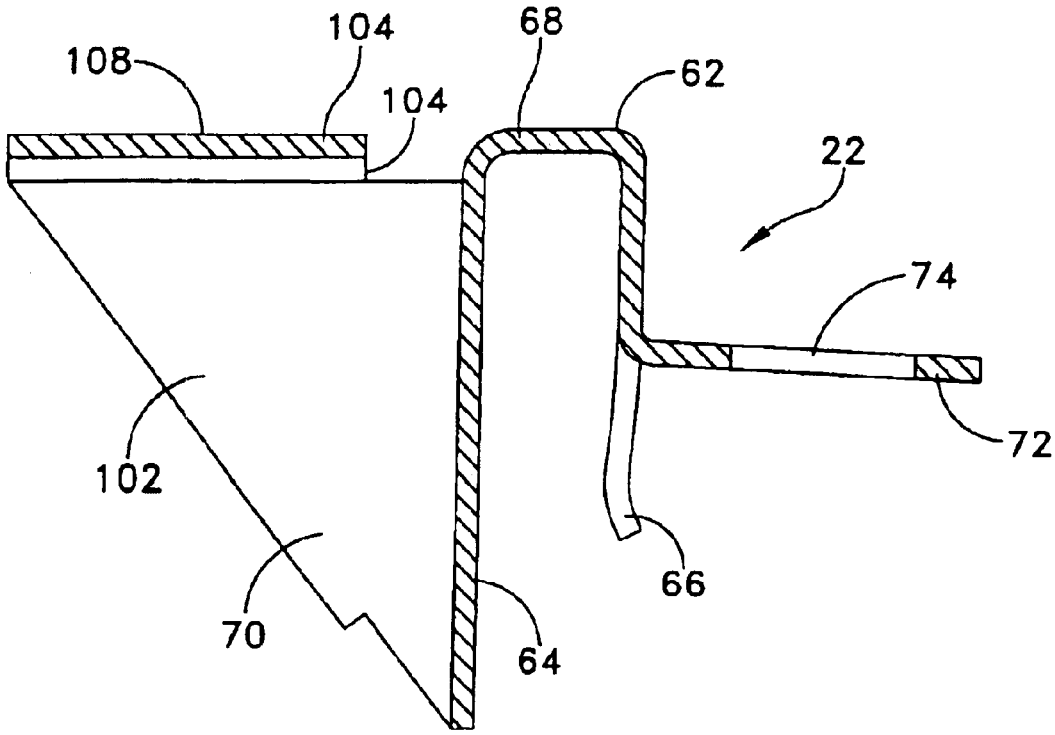
FIG. 3B is a sectional view of the clip of the locking device.

Referring to FIGS. 3A and 3B, the clip 22 is shown in perspective and sectional. views. The clip 22 has the "U" shaped portion 62 which includes the pair of downward extending leg portions 64 and 66 extending from the spanning portion 68 which overlies the flange 42 of the wall 40 as seen in FIG. 2. The retaining flange portion 72 extends from the downward extending outer portion leg 66. The retaining flange portion 72 has a hole 74 through which the barrel lock 28 extends. The support bracket portion 70 is formed from a pair of angle supports 102 that project from the inner leg portion 64 and each has a support rib 104 and a stiffening flange 106. The support ribs 104 project from each angle support 102 and are bent toward each other to create a shelf 108 that underlies the cover 32 when the clip 22 is installed on the electrical meter socket 30. The stiffening flanges 106 each project outward from one of the angle supports 102 as best seen in FIG. 3A.

In a preferred embodiment, the clip 22 is formed from a single sheet of material. The sheet is bent to the proper shape and spot welded or resistance welded.

Figure 4C:
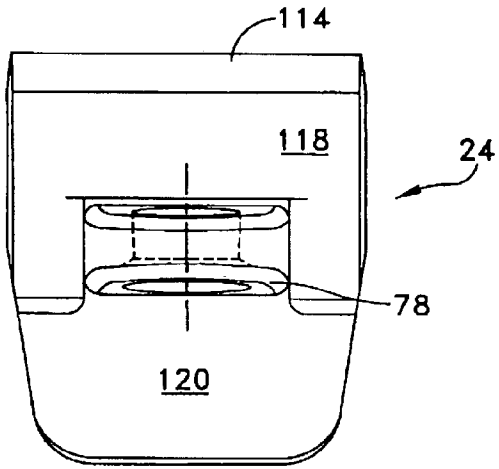
FIG. 4C is a front view of the base of the locking device.
Figure 4A:
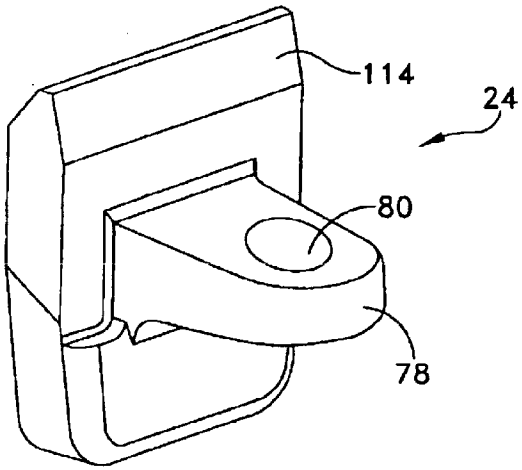
FIG. 4A is a perspective view of the base of the locking device.
Figure 4B:
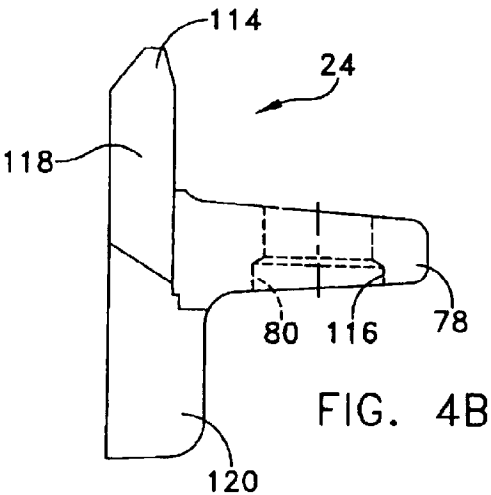
FIG. 4B is a side view of the base of the locking device.

Referring to FIG. 4A, a prospective view of the base 24 is shown. The base 24 has a tapered upper edge 114 to facilitate installation of the base 24 between the wall of the electric meter box 38 and the outer leg portion 66 of the clip 22 as seen in FIG. 2. The retaining flange portion 78 has the opening 80 through which the barrel lock 28 extends. The opening 80 has an enlarged portion 116 as shown in hidden line in FIGS. 4B and 4C for receiving the locking balls or members 140 of the barrel lock 28 as shown in FIG. 2. The base 24 above the retaining flange portion 78, an upper portion 118, is thinned as compared to the lower portion 120. The upper portion 118 receives the outer leg portion 66 of the "U" shaped portion 62 of the clip 22.

In the embodiment shown in FIG. 2, the thickness of the outer leg portion 66 of the "U" shaped portion 62 of the clip and the thickness of the flange 46 of the cover 32 fills the difference in thickness between the upper portion 118 of the base 24 and the lower portion 120, such that the body 26 engages a flat surface.

In an embodiment, the base 24 is formed by casting of a malleable iron. The base 24 is machined to form the opening 80 and the upper portion 118. In one embodiment, the base 24 is sized so that it is frictionally held by the outer leg portion 66 of the clip 22 for ease of installation. The clip 22 retains the base 24 to allow the user to position the body 26 and the lock 28 with her/his hands.

Figure 5A:
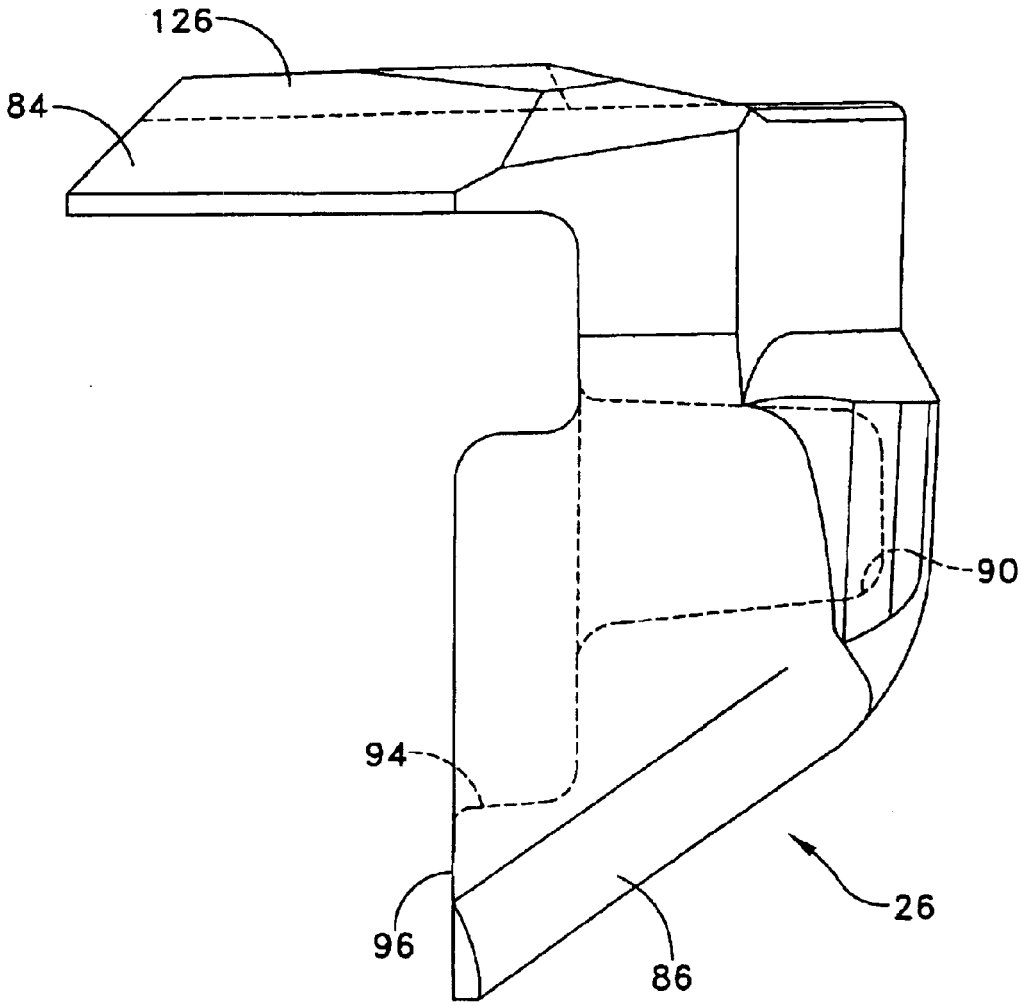
FIG. 5A is a side view of the body of the locking device.

Referring to FIG. 5A, a side view of the body 26 of the locking device 20 is shown. The body 26 has generally an upside down "L" shape wherein the cover extending portion 84 of the "L" shape overlies the cover 32 of the electrical meter socket 30 as shown in FIG. 2. The vertical extending portion 86 has the cavity 90 as shown in hidden line for receiving the retaining flange portion 72 of the clip 22 and the retaining flange portion 78 of the base 24.

As seen in FIG. 5A, the body 26 is formed having numerous surfaces and curved portions. With the number of surfaces angled to each other, as shown, and the curved portions, it is difficult for a tool such as tongue and groove pliers or a wrench to grab on to the body 26 in order to attempt to physically pull the locking device 20 off of the electrical meter socket 30.

Figure 5B:
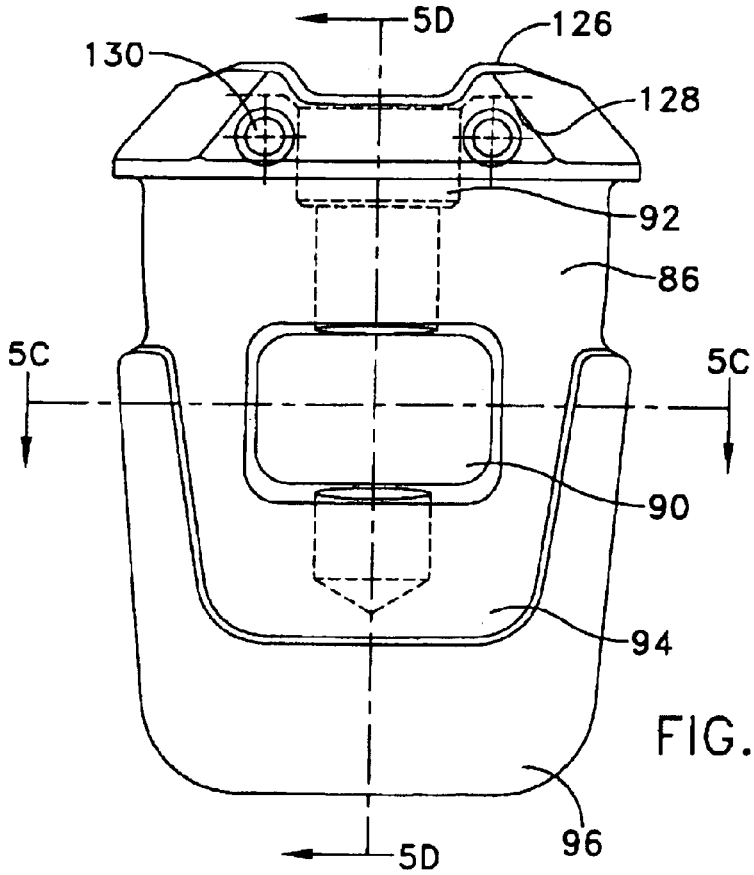
FIG. 5B is a front view of the body of the locking device.

The cover retaining portion 84 of the body 26 in addition to having numerous surfaces has a pair of raised ribs 126. Referring to FIG. 5B, a front view, a view of the surface that faces the wall 40 of the box 38 of the electrical meter socket 30, the cover retaining portion 84 of the body 26 is shown to have a hole 128 in each of the raised ribs 126. Each hole 128 receives a hardened steel pin 130 to strengthen the cover retaining portion 84 of the body 26 therein reducing the possibility that someone can cut through this cover retaining portion 84 of the body to circumvent the locking device. The body 26 has the cavity 90 in the extending portion 86 for retaining the retaining flange portion 72 of the clip 22 and the retaining flange portion 78 of the base 24. In addition, there is the larger groove 94 in which the base 24 is received. The "U" shaped lip 96 of the extending portion 86 underlies the cavity 90 and the groove 94 limits access to the base 24 when the entire locking device 20 is secured to the electrical meter box 30. The bore 92 in the body 26 for receiving the barrel lock is shown in dotted line and extends through the cavity in the body.

Figure 5C:
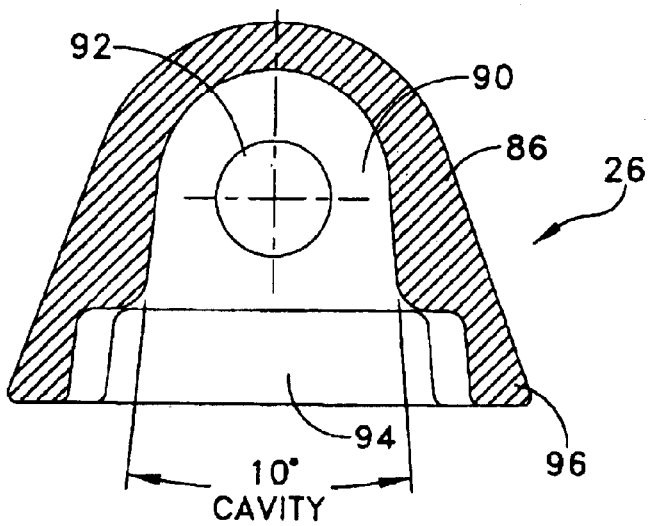
FIG. 5C is a sectional view of the body of the locking device taken along the line 5C—5C of FIG. 5B.

FIG. 5C is a sectional view taken along the lines 5C—5C of 5B. The cavity 90 has side walls that angle inward. The top and bottom wall likewise angle inward. The angled walls allow for easy molding. The taper of the "U" shaped groove or pocket 94 for receiving the base has the "U" shaped lip 96 encircling it on three sides. The bore 92 for receiving the barrel lock 28 is shown.

Figure 5D:
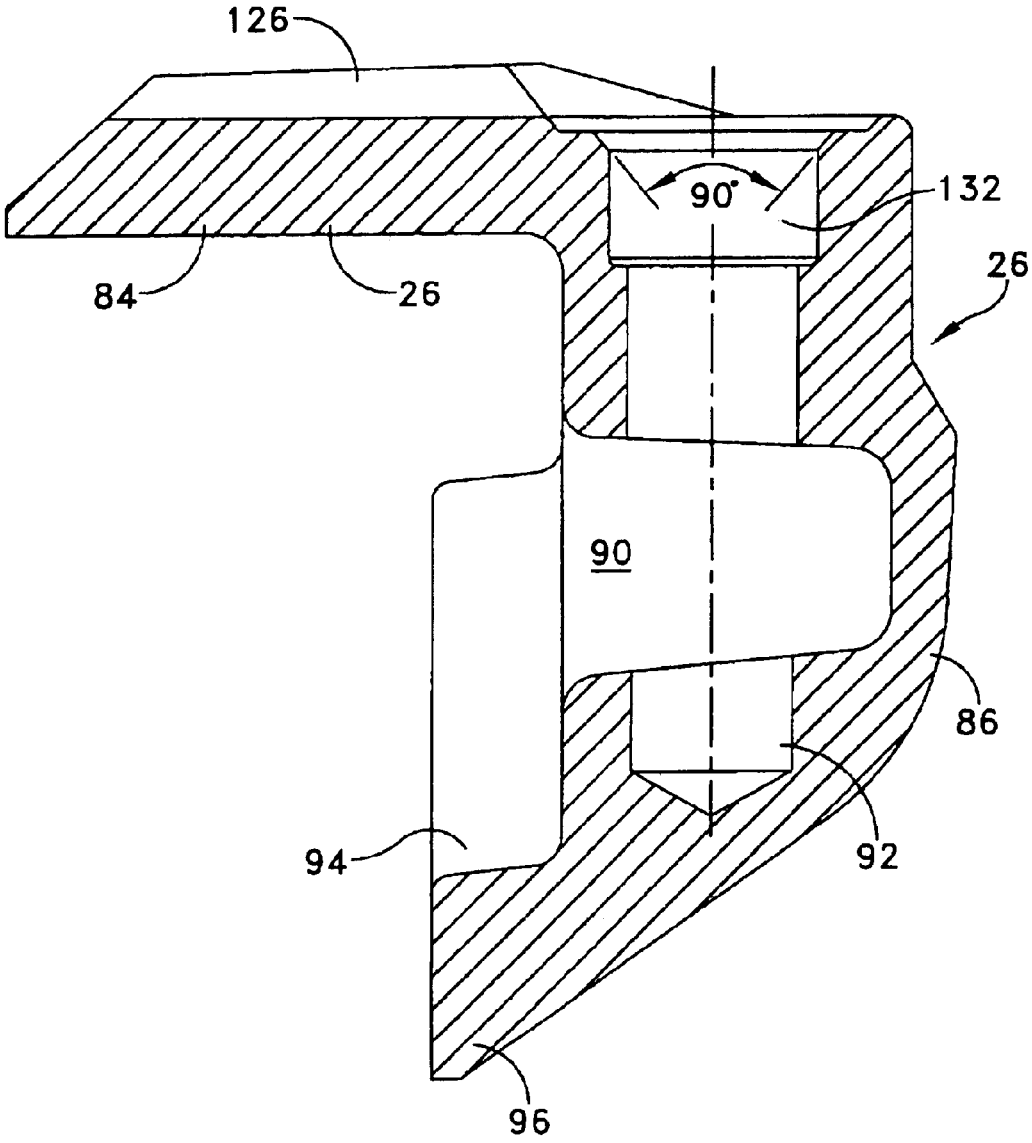
FIG. 5D is a sectional view of the body of the locking device taken along the line 5D—5D of FIG. 5B.

FIG. 5D is a sectional view taken along the lines 5D—5D of FIG. 5B. The body 26 has the rib 126 projecting upward on the cover retaining or top portion 84. The bore 92 extends in the vertical direction through the extending portion 86 and cuts through the cavity 90. The bore 92 has an enlarged portion 132 that receives the upper portion of the barrel lock 28. The body 26 has a chamfer at the top of the bore 92 to eliminate sharp corners. The "U" shaped groove 94 with the encircling "U" shaped lip 96 is shown. As discussed above, the body 26 is formed of numerous surfaces to make it difficult for a tool, such as a wrench to grab on to the body 26.

In one embodiment, the body 26 is formed from a casting of a malleable iron, the hardened steel pins strengthen the cover retaining portion. It is recognized that the entire base 26 can be a hardened shell.

Figure 6:
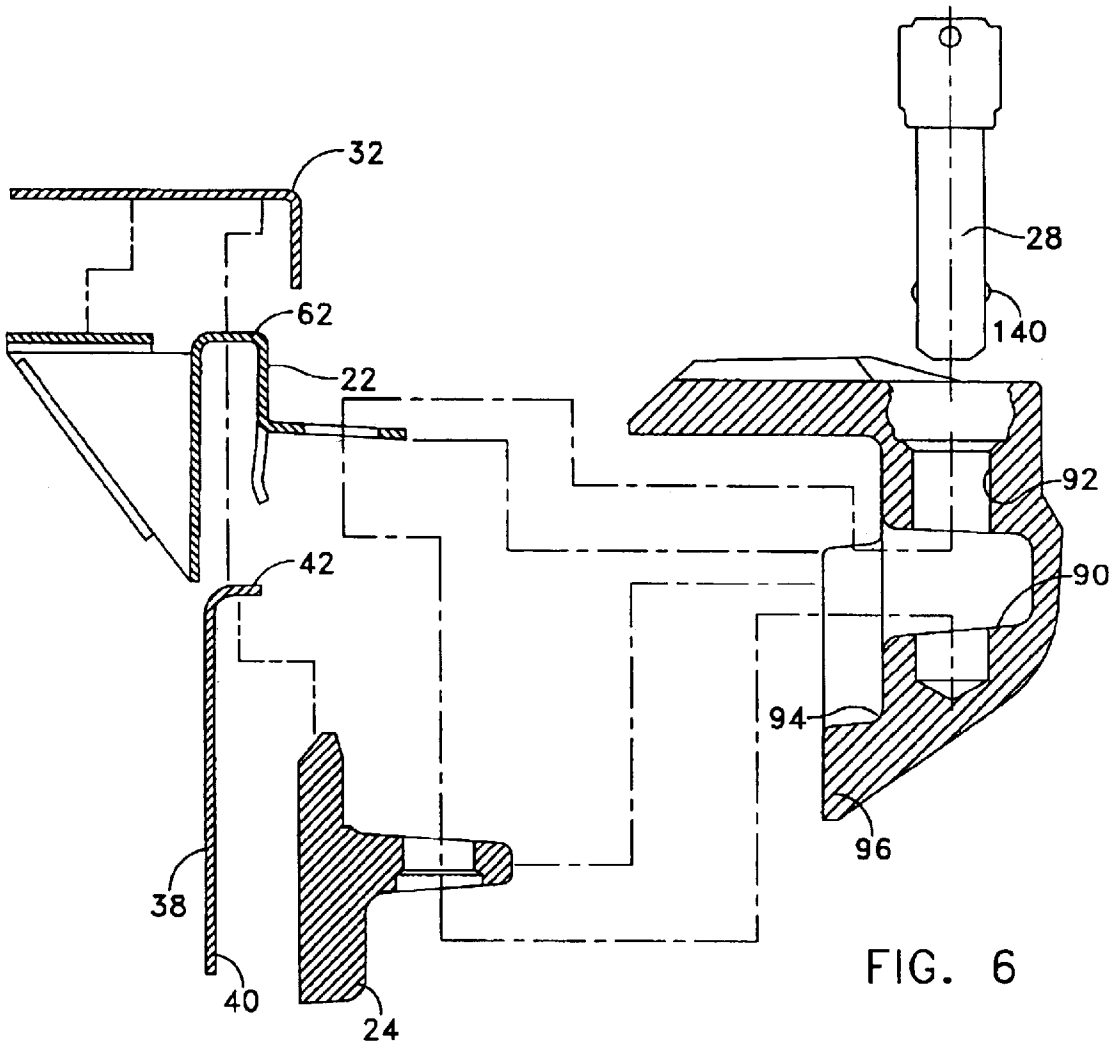
FIG. 6 is an exploded view of the components of the locking device.

FIG. 6 is an exploded view of the components of the locking device 20 in relation to the electrical meter socket 30. The clip 22 is positioned over the wall 40 and flange 42 of the box 38. The base 24 is slid in between the "U" shaped portion 62 of the clip 22 and with the wall 40 of the box 38. With the clip 22 and the base 24 in position, the cover 32 is positioned on the socket 38 of the electrical meter socket 30. The clip 22 and base 24 can be retained on the box 30 when a person is working on the electrical box 30, prior to placing the cover 32 on the box 38. When it is desired to lock the box, with the cover 32 in position, the body 26 is positioned such that the cover retaining portion or top portion overlies the cover 32 and the cavity receives the retaining flange portion 72 of the clip 22 and the retaining flange portion 78 of the base 24. The body 26 is secured by generally positioning it from the side. With the body 26 aligned with the clip 22 and the base 24, the holes or openings in the clip 22 and the base 24 align with the bore 92 in the body 26, and the barrel lock 28 extends through the bore 92 and is keyed such that the locking balls or members sit outward and prevent the barrel lock 28 from being extracted.

Further details relating to the barrel lock 28 can be found in U.S. Pat. No. 4,712,395, which the entire contents is incorporated herein by reference.

In order to install the locking device 20, the barrel lock 28 is removed and the lock components of the clip 22, the base 24, and the body 26 are separated. The clip 22 is positioned and held over the flange of the meter socket. While holding the clip 22, the base 24 of the locking device 20 is slid into position. The cover 32 is replaced on the box 38. The body 26 of the locking device 20 is installed over the clip 22 and the base 24. The barrel lock is installed into the lock body 26 to complete installation.

The locking device 20 does not require the user to drill or punch holes in either the box or the cover of the electrical meter socket for installation. In that the locking device 20 does not have holes in the electrical meter socket to properly secure the electrical meter socket, the locking device can be installed in a fraction of the time needed to install the locking devices that require a hole in the electrical meter socket.

In the embodiment shown in FIG. 1A, there are two locking devices 20 located at generally opposite corners of the electrical meter socket 30 to secure the cover 32 of the electrical meter socket 30 to the box 38.

The claims should not be read as limited to the described order or elements unless stated to that effect. Therefore, all embodiments that come within the scope and spirit of the following claims and equivalents thereto are claimed as the invention.

What is claimed:

1. A lock assembly for an enclosure having a box with a side wall and a cover, the lock assembly comprising:

a clip having a "U" shaped portion constructed and arranged to encircle the side wall of the enclosure, the "U" shaped portion having an inner leg, a spanning portion, and an outer leg, the clip having a support portion projecting from an inner leg for supporting the cover, and an interface portion projecting from the outer leg;

a base constructed and arranged to be interposed between the side wall of the enclosure and the outer leg of the clip, the base having a flange portion projecting outward and underlying the interface portion of the clip, the flange portion having a hole;

a body having an "L" shape including a cover retaining portion and an extending portion, the extending portion having a bore extending from the cover retaining portion, the body having a cavity opening onto an inner surface, the cavity receiving the flange portion of the base and the interface portion of the clip; and an interlocking mechanism receivable by the bore of the body and interrelating with the interface portion of the clip and the flange portion of the base for securing the body to the base and the clip, and securing the cover to the box.

2. The lock assembly of claim 1 wherein the support portion of the clip has a shelf supported by a pair of support brackets extending from the inner leg, the shelf position being in close proximity to the cover of the enclosure during use.

3. The lock assembly of claim 2 wherein the clip is formed of a single piece of material.

4. The lock assembly of claim 1 wherein the interface portion of the clip is a flange portion having a hole.

5. The lock assembly of claim 1 wherein the base has a tapered upper edge for facilitating installation.

6. The lock assembly of claim 5 wherein the base has a thinned upper portion for receipt of the outer leg of the clip.

7. The lock assembly of claim 5 wherein the hole in the base has an enlarged area for receipt of a locking device of the interlocking mechanism.

8. The lock assembly of claim 1 wherein the body has a plurality of surfaces angled to each other and curved surfaces to limit the surfaces from being securely retained by a tool.

9. The lock assembly of claim 1 wherein the body has at least one hole extending in the cover retaining portion and further comprising at least one hardened steel pin received by the hole.

10. The lock assembly of claim 1 wherein the body has a "U" shaped lip for encircling the base.

11. The lock assembly of claim 1 wherein the interlocking mechanism is a barrel lock with a pair of locking balls.

12. A lock assembly for an enclosure having a box with a side wall, and a cover, the lock assembly comprising:

a clip having a "U" shaped portion constructed and arranged to encircle the side wall of the enclosure, the "U" shaped portion having an inner leg, a spanning portion, and an outer leg, and the clip having a support portion projecting from an inner leg for supporting the cover;

a base constructed and arranged to be interposed between the side wall of the enclosure and the outer leg of the clip, the base having a flange portion projecting outward and underlying a portion of the clip, the flange portion having a hole;

a body having an "L" shape including a cover retaining portion and an extending portion, the extending portion having a bore extending from the cover retaining portion, the body having a cavity opening onto an inner surface, the cavity receiving the flange portion of the base and a portion of the clip; and an interlocking mechanism receivable by the bore of the body and interrelating with the support portion of the clip and the flange portion of the base for securing the body to the base and the clip, and securing the cover to the box.

13. The lock assembly of claim 12 the support portion of the clip has a retaining flange portion projecting from the outer leg, the retaining flange portion having a hole to accept the interlocking mechanism.

14. The lock assembly of claim 12 wherein the support portion of the clip has a shelf supported by a pair of support brackets extending from the inner leg, the shelf position being in close proximity to the cover of the enclosure during use.

* * * * *